United States Patent [19]

Kolstedt et al.

[11] Patent Number: 4,858,596

[45] Date of Patent: Aug. 22, 1989

[54] PORTABLE SEQUENTIAL COMPRESSION DEVICE

[75] Inventors: Mark Kolstedt, Algonquin; John F. Dye, Elgin, both of Ill.

[73] Assignee: The Kendall Company, Boston, Mass.

[21] Appl. No.: 157,689

[22] Filed: Feb. 18, 1988

[51] Int. Cl.[4] ..... A61H 9/00

[52] U.S. Cl. ..... 128/24 R; 128/64

[58] Field of Search ..... 128/64, 65, DIG, 20, 128/24 R, DIG. 10, 160, 44

[56] References Cited

U.S. PATENT DOCUMENTS

| | | | |
|---|---|---|---|
| 1,253,233 | 1/1918 | Guilford | 128/64 |
| 2,113,253 | 4/1938 | Gray | 128/DIG. 20 |
| 2,145,932 | 2/1939 | Israel | 128/64 |
| 2,345,073 | 3/1944 | Rosett | 128/DIG. 20 |
| 2,781,041 | 2/1957 | Weinberg | 128/24 R |
| 3,179,106 | 4/1965 | Meredith | 128/64 |
| 3,862,629 | 1/1975 | Rotta | 128/DIG. 20 |
| 4,374,518 | 2/1983 | Villanueva | 128/64 |

*Primary Examiner*—Edgar S. Burr
*Assistant Examiner*—Huong Q. Pham
*Attorney, Agent, or Firm*—Alvin Isaacs

[57] ABSTRACT

A sequential compression device for delivering pressurized air to a multi compartment inflatable sleeve on a patient's limb. The device includes a pump, a plurality of cam actuated valves and a plurality of conduits in communication with said valves, all disposed within an accumulator, which comprises the housing for the device as well.

11 Claims, 2 Drawing Sheets

PORTABLE SEQUENTIAL COMPRESSION DEVICE

BACKGROUND OF THE INVENTION

1. Field of the Invention

This invention relates to therapeutic and prophylactic devices, and more particularly to devices for applying compressive pressures against a patient's limb.

2. Prior Art

Velocity of the flow of blood in patient's arms and legs particularly the legs, markedly decreases during the term of confinement of the patient. This slow-down in the velocity of blood in those extremities causes a cooling or stasis of blood which is particularly pronounced during surgery, immediately after surgery, and when the patient has been confined to bed for extended periods of time. The stasis of blood is a significant cause of the formation of thrombi in the patient's extremities, which would have a severe deleterious effect on the patient. Additionally, in certain patients, it is desirable to move fluid out of enterstital spaces in the tissues of their extremities, in order to reduce swelling associated with edema in those extremities.

U.S. Pat. No. 4,013,069 to Hasty, discloses a sequential intermittent compression device for applying compressive pressures against a patient's limb, from a source of pressurized fluid.

U.S. Pat. No. 4,338,923 shows an inflatable-cell body treating apparatus having a compressor attached to a receiver which directs the compressed air through a reduction valve then to an inlet port of a rotary distributor, eventually to an inflatable band.

U.S. Pat. No. 3,862,629 shows a fluid pressure control apparatus including a complicated scillatory valve arranged from a supply system to an exhaust, which feeds a plurality of inflatable chambers disposed about a patient's limb.

U.S. Pat. No. 2,528,843 discloses an intermittent pressure generator comprising a piston-cylinder arrangement with a plurality of take-off tubes in communication with the cylinder, to supply pressurized fluid to a sleeve.

Some of the prior art compressive devices are expensive to manufacture, are complicated and cumbersome, and inconvenient to use, particularly in a home care environment, where sophisticated technical help is not readily available.

It is an object of the present invention to provide an intermittent compressive device for sequentially generating fluid pressures and providing such compressive fluid to a sleeve adapted about a patient's limb.

It is a further object of the present invention to provide a small, self-contained compressive device that is easy to use and carry, with minimum inconvenience.

BRIEF SUMMARY OF THE INVENTION

The present invention comprises a sequential compression device for supplying pressure sequentially to an inflatable elongated sleeve which is utilized to pressurize a patient's limb.

The sequential compression device comprises a housing having an upper housing portion and a lower housing portion. The upper and lower housings define an accumulator. The accumulator directs pulses of pressurized air through a plurality of conduits, to the inflatable sleeve.

The lower housing has a generally flat lower surface and is surrounded on its periphery by four upstanding walls having a common planer uppermost edge.

A vacuum pump is secured to the lower surface of the lower housing and has an intake line in fluid communication with an orifice in a wall of the lower housing. The vacuum pump has a discharge orifice on the pump housing which discharges pressurized air directly into the housing, that is, the accumulator. An electric motor is attached to and provides rotational impetus for the pump.

An exhaust manifold is disposed in the accumulator, adjacent the pump. The manifold has a plurality of conduits, having their proximal ends open to the atmosphere in the accumulator. The conduits are directed through an upstanding wall and are connected at their distal ends to a discharge manifold in an outer wall in the lower housing.

A plurality of stoppers are pivotably disposed at the proximal ends of the conduits at the exhaust manifold. Each stopper is disposed on the distal end of a arm, which is biased so as to direct each stopper against its respective conduit, at the exhaust manifold.

A ganged cam arrangement is disposed parallel to the pivotably disposed stoppers. The ganged cam arrangement is rotatively connected to a small synchronous motor. The cam arrangement controls the movement of the stoppers onto and away from the conduits at the exhaust manifold. A position indicator is attached to each stopper. Each position indicator moves with each stopper, into and out of an optical sensor. The sensor determines the location of its particular position indicator and provides feedback to a proper circuit controlling the cam drive motor and the pump drive motor.

In operation, the pump pressurizes the accumulator, when the upper housing is disposed upon the lower housing, and the proper circuitry is initiated.

The proximal ends of the conduits thus receive the pressurized air, pumped into the accumulator from the pump adjacent them, in the accumlulator itself. The stoppers governed by their cams, control the flow of pressurized air into the conduits, and hence into any compartment of the sleeve in communication with the discharge manifold through the housing.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
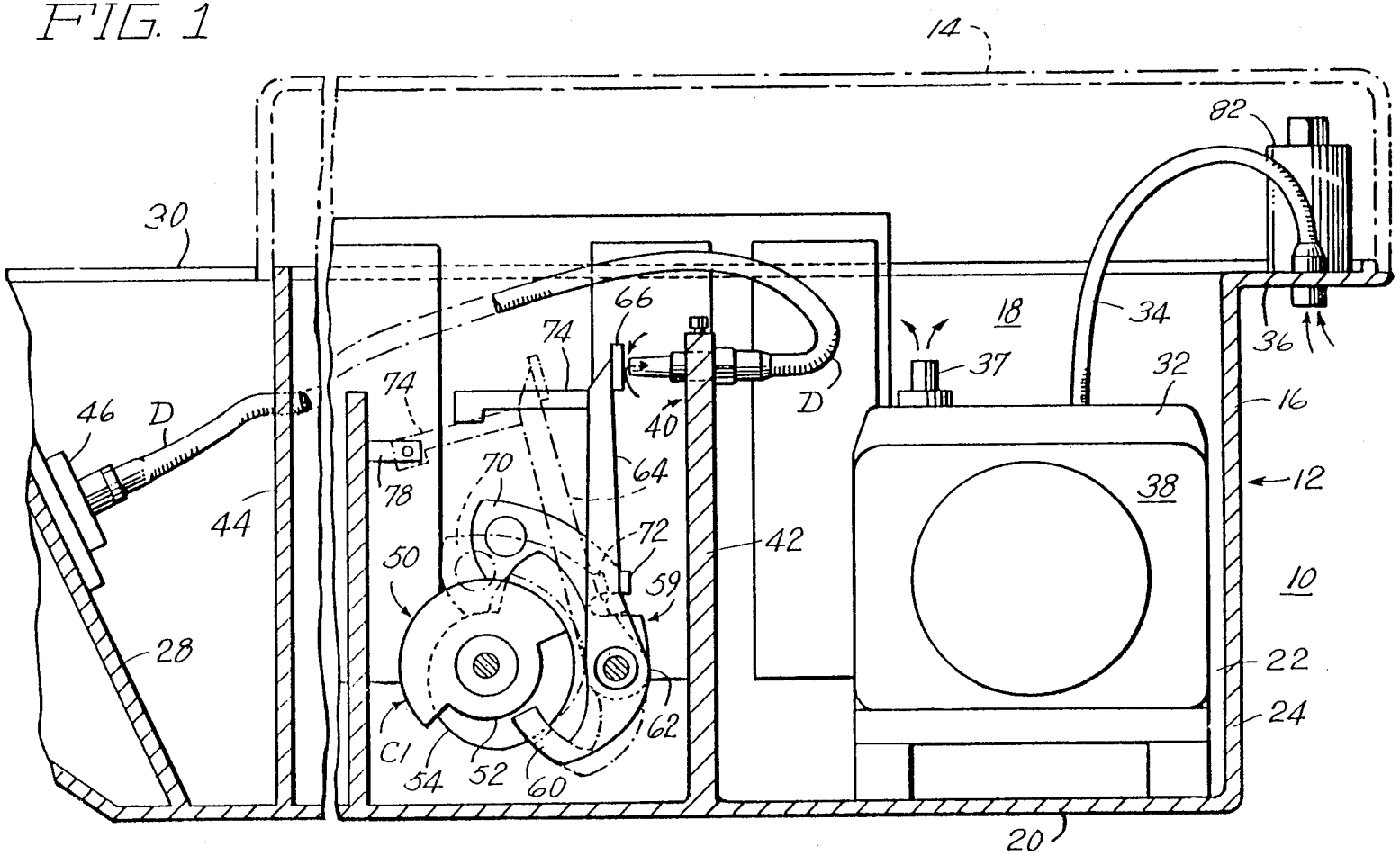
FIG. 1 is a side elevational view, partly in section of an accumulator system constructed according to the principles of the present invention.

Referring now to the drawings in detail, and particularly to FIG. 1, there is shown a sequential compression device 10 for supplying pressure sequentially to an inflatable sleeve, such as that shown in U.S. Pat. No. 4,198,961 to Arkans, and assigned to the assignee of the present invention, which patent is incorporated herein by reference.

The sequential compression device 10 comprises a housing 12 having an upper housing portion 14 and a lower housing portion 16. The upper and lower housing portions 14 and 16 define an accumulator 18 capable of containing a volume of about 3 liters of pressurized air at a pressure of at least 5 psi. The lower housing 16 has a generally flat lower surface 20 and is surrounded on its periphery by four upstanding walls 22,24,26 and 28, having a common planar uppermost edge 30.

A vacuum pump 32 is secured to the lower surface 20 of the lower housing 16. The pump 32 has an intake conduit 34 which extends through a lip 36 on the rear of the lower housing 16. The conduit 34 supplies the air, which the pump 32 pressurizes, and discharges the air into the accumulator 18 through a discharge port 37. The pump 32 is rotatively driven by an electric motor 38.

An exhaust manifold 40 is arranged within the accumulator 18 adjacent the pump 32. The manifold 40 comprises four conduits A,B,C, and D having their proximal ends secured within the accumulator 18 by a bracket 42. Each of the conduits A,B,C, and D are directed through an upstanding wall 44 and proceed to a discharge manifold 46 in the outer wall 28 in the lower housing 16. The discharge manifold 46 would typically be matingly attached to a plurality of conduits, not shown, for supplying an inflatable sleeve, as described in the above mentioned patent.

Figure 2:
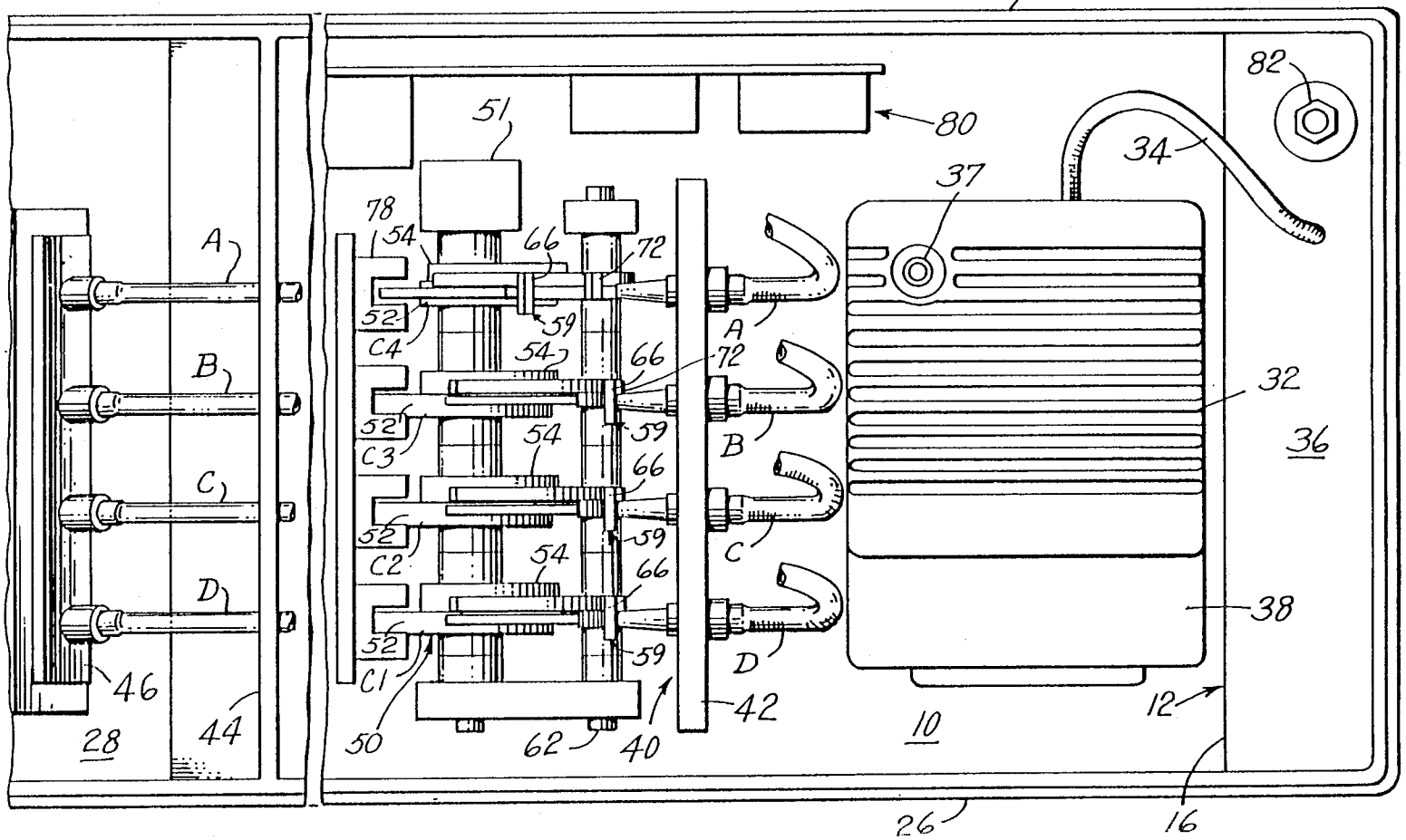
FIG. 2 is a plan view of the accumulator system shown in FIG. 1.

A ganged cam arrangement 50 is disposed parallel to the exhaust manifold 40, and is rotatively driven by a small synchronous motor 51, as is shown in FIG. 2. The cam arrangement 50 comprises four cams C1, C2, C3 and C4. Each cam C1, C2, C3 and C4 has a first and second cam surface 52 and 54. A main cam follower 60 biasedly pivots about a pivot in 62. The main cam follower 60 has an extended arm 64 therewith. The arm 64 has a stopper 66 which acts as a valve with respect to the proximal (open) end of its respective conduit A,B,C, or D. A second cam follower 70 is in registration with the second cam surface 54. The second cam follower 70 has a spring bias means 72 which acts to push the stopper 66 away from the proximal end of its respective conduit A,B,C, or D. The arm 64 has a position finger 74 which is displaced, when the stopper 66 is displaced from its conduit A,B,C, or D. The finger 74 has a flag 76 on its distal end which engages an optical sensor 78. The optical sensor 78 is in communication with a proper control circuit 80, which provides proper feedback to control the electric motors 38 and 51 running the pump 32 and the cams 50. A dump valve 82 controls any overpressure, and will shut off the pumps 32 through the proper control circuit 80 if the pressure within the accumulator 18 exceeds a certain level.

The air pressure within the accumulator 18 is thus caused to selectively enter the particular conduits A,B,C, or D when their respective stopper 66 is displaced therefrom. Each stopper 66 is displaced according to the angular relationship of adjacent cams C1, C2, C3, and C4 in the ganged cam arrangement 50.

A delivery conduit, not shown, would be attachable to the discharge manifold 46 to deliver pressurized fluid to an attached sleeve, not shown, to permit sequential pressures to be delivered to that sleeve.

We claim:

1. A sequential compression device for delivering sequentially pressurized air for medical purposes to an inflatable multi-compartment sleeve, comprising:

an accumulator having walls to define a containment housing for containing pressurized air therein, said accumulator housing also containing:

a pump to generate pressurized air into said accumulator housing;

a plurality of conduits each having a proximal open end within said accumulator housing and a distal end disposed through a wall of said accumulator housing; and a plurality of valves to control the flow of pressurized air into said conduits;

said conduits, said pump and said valves being disposed within said accumulator housing, to compress said air therewithin, and to selectively discharge said pressurized air through said conduits in said accumulator housing for discharge to an inflatable sleeve.

2. A sequential compression device as recited in claim 1, wherein said conduits are being arranged with respect to a plurality of stoppers, each of said stoppers being controlled by a cam arrangement for moving said stoppers with respect to the proximal ends of said conduits, so as to regulate the pressurized air entering said conduits.

3. A sequential compression device is recited in claim 1, wherein an electric motor is arranged to drive said pump disposed in said accumulator.

4. A sequential compression device as recited in claim 2, wherein said conduits are secured to a bracket in said accumulator, so as to present said proximal ends to said stoppers.

5. A sequential compression device as recited in claim 2 wherein said cam arrangement comprises a plurality of cams which each have a multiple cam surface and a pair of cam followers arranged to move each of said stoppers with respect to said open ends of said conduits.

6. A sequential compression device as recited in claim 5, wherein said cam arrangement is rotatively powered by an electric motor.

7. A sequential compression device as recited in claim 5, wherein said cams are connected to one another, and are angularly arranged with respect to one another so as to effectuate timed opening and closing of said open ends of said conduits.

8. A sequential compression device as recited in claim 2, wherein said accumulator comprises an upper housing and a lower housing, said lower housing supporting said pump, motor, and valves therein, said upper housing comprising a cover for enclosing said lower housing.

9. A sequential compression device as recited in claim 8, wherein a dump valve is disposed in said lower housing, to discharge excess pressure from said accumulator.

10. A sequential compression device as recited in claim 8, wherein said lower housing has an orifice and a conduit extending therefrom leading to said pump to provide an air source therefor.

11. A sequential compression device as recited in claim 5, wherein a position optical sensing device is arranged with a finger disposed with respect to one of said cam followers on each cam, so as to indicate the position of each of said stoppers with its respective conduit.

* * * * *